United States Patent [19]

Shimura

[11] Patent Number: 4,886,309

[45] Date of Patent: Dec. 12, 1989

[54] LINK COUPLING ARRANGEMENT FOR VEHICLE DOOR LOCK ASSEMBLY

[75] Inventor: Ryoji Shimura, Yokohama, Japan

[73] Assignee: Ohi Seisakusho Co., Ltd., Kanagawa, Japan

[21] Appl. No.: 134,250

[22] Filed: Dec. 17, 1987

[30] Foreign Application Priority Data

Dec. 18, 1986 [JP] Japan ..... 61-194698

[51] Int. Cl.[4] ..... E05C 21/00

[52] U.S. Cl. ..... 292/336.3

[58] Field of Search ..... 292/216, 280, 336.3

[56] References Cited

U.S. PATENT DOCUMENTS

| | | | |
|---|---|---|---|
| 1,490,777 | 4/1924 | La Fortune | 292/168 X |
| 1,766,366 | 6/1930 | Welch et al. | 292/30 |
| 4,005,887 | 2/1977 | Itakura | 292/216 |
| 4,762,349 | 8/1988 | Ikeda | 292/216 |
| 4,775,176 | 10/1988 | Ikeda | 292/216 |

FOREIGN PATENT DOCUMENTS 953264 3/1964 United Kingdom .

*Primary Examiner*—Richard E. Moore

*Attorney, Agent, or Firm*—Lowe, Price, LeBlanc, Becker & Shur

[57] ABSTRACT

A link coupling arrangement for a vehicle door lock assembly in which two transmission link members are interlockably mounted on a body of the vehicle door lock assembly. This arangement is characterized in that the two transmission link members are interlockably connected by a coupler member and the coupler member is connected to another transmitting member. With this arrangement, there is no need to reserve a space for connection for the transmitting member in addition to a space for connection between the two transmission link member, saving a space for the connecting portion for the transmitting member. Therefore, the entire structure of the door lock assembly can be made compact. Furthermore, the structure of the link coupling arrangement can be simplified and the fabrication thereof can be simplified.

7 Claims, 4 Drawing Sheets

LINK COUPLING ARRANGEMENT FOR VEHICLE DOOR LOCK ASSEMBLY

FIELD OF THE INVENTION

This invention relates to a link coupling arrangement for a door lock assembly of a vehicle, especially, of an automobile, in which two transmission link members are interlockably mounted on a body of the door lock assembly.

BACKGROUND ART

A link coupling arrangement is known wherein two transmission link members are interlockably mounted on a body of a door lock assembly and one of the two transmission link members is connected to another transmitting member through a coupler member.

A link coupling arrangement as illustrated in FIGS. 8 and 9 is also known, in which the link coupling arrangement is used for a rear door lock assembly.

More specifically, a lock lever 2 and sub lever 3, which are transmission link members, are rockably mounted on a body 1 of the door lock assembly. The engagement or connection (indicated by 4 in FIGS. 8 and 9) of the lock lever 2 with the sub lever 3 is attained by slidably inserting an end portion of the sub lever 3 into a buffer 5 on a flange portion 2*a* of the lock lever 2. A connection 7 between a flange portion 2*b* of the lock lever 2 and a drive rod 6, a transmitting member, is provided above (front side in FIG. 8 and below in FIG. 9) said connection 4 between the lock lever 2 and the sub lever 3 where the connection 7 overlaps the connection 4. With this arrangement, when the drive rod 6 is operated, the lock lever 2 and the sub lever 3 oscillate between the lock and release position.

In such a conventional link coupling arrangement for the vehicle door lock assembly, however, the connection for the transmitting member is provided at a separate position from the connection between the two transmission link members. This requires a space for the connection for the transmitting member in addition to the space for the connection between the two transmission link members. Therefore, the entire door lock assembly is bulky and the structure of the assembly is complicated, preventing reduction in size of and simplification of the door lock assembly.

In particular, when the door lock assembly is used as a lock assembly for a rear door as illustrated in FIGS. 8 and 9, it is very important to reduce the thickness of the door lock assembly as much as possible, to reserve a sufficient space between a window glass 8 of the rear door and the door lock assembly within a limited space.

In the conventional door lock assembly as described above, however, the connection 7 for the drive rod 6 is provided in a different position in the thickness direction of the rear door from the connection 4 between the lock lever 2 and the sub lever 3. Consequently, the body 1 of the door lock assembly is thick and it is difficult to reduce the thickness of the body 1 of the door lock assembly.

To reduce the thickness of the body 1 of the door lock assembly, the connection 7 for, the drive rod 6 may be placed in a lower position (back side in FIG. 8 and upper in FIG. 9) as shown by an arrow A in FIG. 8, in which position the connection 7 is in a non-overlapping position with respect to the connection 4, without moving the position of the rocking center, or a pivot, of the lock lever 2. In this case, deviation or shaking of an axis (indicated by a dot-and-chain line in FIG. 8) of the drive rod 6 becomes larger as the connection 7 is drawn by the drive rod 6, so that the operating force or stroke can not effectively be used. As a result of this, the operation efficiency of the driving rod 6 are lowered.

To reduce the thickness of the body 1 of the door lock assembly, without lowering the operating efficiency of the drive rod 6, the rocking center of the lock lever 2 should be moved together with the connection 7. In this case, however, the body 1 of the door lock assembly should be larger in the width direction though the body 1 of the door lock assembly can be thinner. Thus, the entire size of the body 1 of the door lock assembly can not be reduced again.

In the conventional structure as described above, the buffer 5 is provided on the flange portion 2*a* of the lock lever 2 and a rod holder 9 is provided in the flange portion 2*b* of the lock lever 2. This arrangement makes the structure complicated and increases the cost of fabrication. Furthermore, when it is necessary to replace the buffer 5 by a new one after the fabrication, it is very difficult to remove the buffer 5 from the connection 4.

DISCLOSURE OF THE INVENTION

It is an object of the present invention to provide a link coupling arrangement for a vehicle door lock assembly which is capable of being made compact in size and simplified in structure.

To attain the object as described above, the present invention features a link coupling arrangement for a vehicle door lock assembly in which two transmission link members are interlockably mounted on a body of the vehicle door lock assembly, which arrangement is characterized in that:

said two transmission link members are interlockably connected by a coupler member; and said coupler member is connected to another transmitting member.

As described above, since the transmitting member is connected to a coupler member which couples the two transmission link members, any one of the two transmission link members and the transmitting member is operated, the other two members effect predetermined movements.

With the arrangement as mentioned above, there is no need to provide a space for connection for the transmitting member in addition to a space for connection for the two transmission link members.

Furthermore, the coupler member is used in common for the coupling of the two transmission link members and for the connection for the transmitting member, so that the structure of the link coupling arrangement can be simplified.

In addition, since the two transmission link members and the transmitting member are all connected by a single coupler member, the fabricating time can be curtailed and the fabricating operation can be simplified.

BRIEF DESCRIPTION OF THE DRAWINGS

FIG. 1 is a front view of a link coupling arrangement for a vehicle door lock assembly;

FIG. 2 is an exploded perspective view of the same;

FIG. 3 is a plan view of the same;

FIG. 4 is a sectional view taken along a line IV—IV of FIG.1;

FIG. 5 is a sectional view taken along a line V—V of FIG. 1;

FIG. 6 is a perspective view of a sub lever as a transmission link member;

FIG. 8 is a front view of a conventional link coupling arrangement for a vehicle door lock assembly; and FIG. 9 is a plan view of the same.

PREFERRED EMBODIMENTS OF THE INVENTION

Referring now the drawings, embodiments of the present invention will now be described.

(First Embodiment)

FIGS. 1 to 6 illustrate a first embodiment of the present invention.

Figure 1:
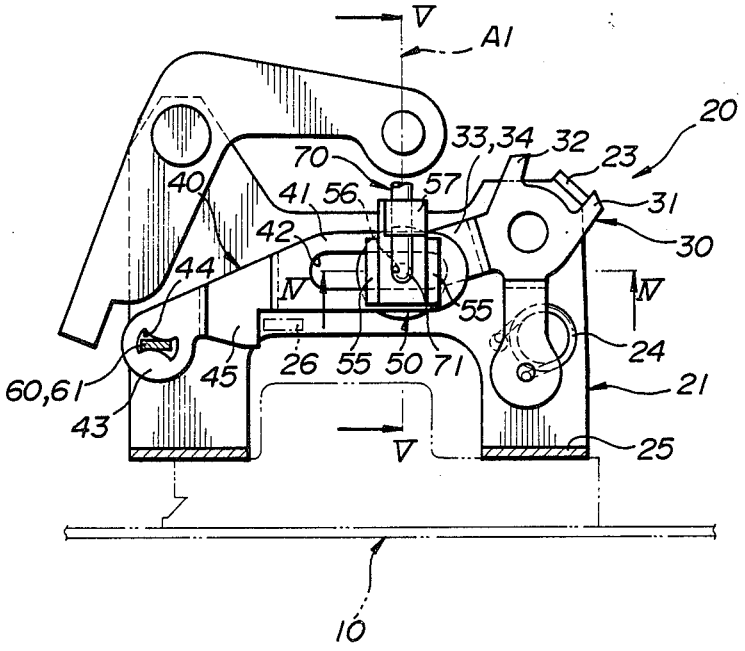
FIGS. 1 to 6 illustrate a first embodiment of the present invention.
Figure 2:
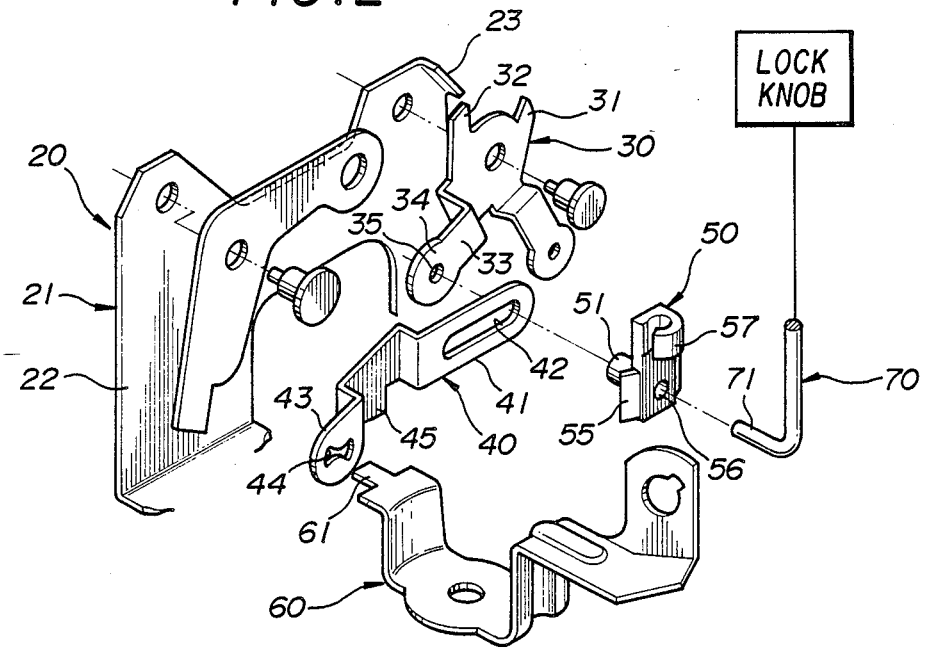
Figure 3:
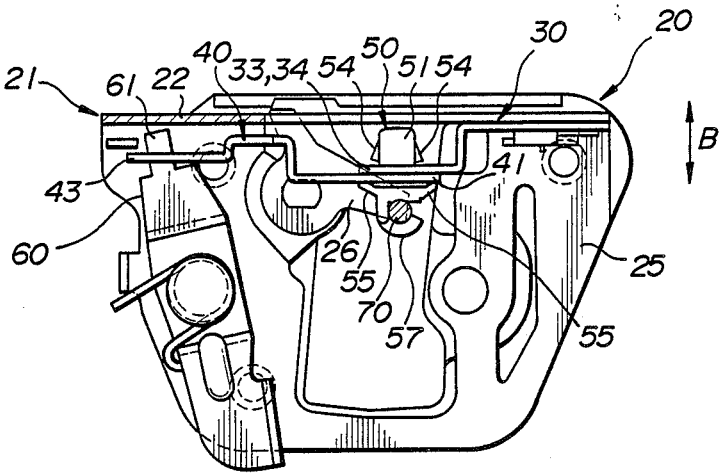

As illustrated in FIGS. 1 to 3, a door lock assembly 20 is used as a lockset for a rear door of a vehicle, for example, an automobile, and mounted on a rear door panel body 10.

Two transmission link members, a lock lever 30 and a sub lever 40, are interlockably mounted on a base member 21 of the door lock assembly 20, so that the two transmission link members may move in gang.

The lock lever 30 is rockably or swingably mounted on a wall portion 22 of the base member 21. The lock lever 30 has two positioning lugs 31 and 32. These lugs are adapted to abut against a locking projection 23 formed on the wall portion 22 of the base member 21. The lock lever 30 is urged or biased by a spring member 24 to a locking position or free position (released position) den which the lug 31 or 32 rests against the locking projection 23.

The lock lever 30 further has a swingable leg 33 which extends over the wall portion 22 of the base member 21 from a center of the rocking motion towards a central portion of the wall portion 22. A tip end portion 34 of the swingable leg 33 has an insertion hole 35. This insertion hole 35 provided at the tip end portion 34 of the swingable leg 33 is so adapted as to receive a leg portion 51 of a rod holder 50 therein. The rod holder 50 functions as a coupler member. The tip end portion 34 of the swingable leg 33 is spaced from the wall portion 22 of the base member 21 by a predetermined distance (a little longer than a total length of the leg portion 51 of the rod holder 50) in the assembled position.

As can be seen from FIG. 2, a tip end portion 41 of the sub lever 40 overlaps the swingable leg 33 of the lock lever 30. The sub lever 40 has an elongate slide slot 42 at the tip end portion 41 of the sub lever 40. The elongate slide slot 42 is formed at a position where it can meet the insertion hole 35 formed at the tip end portion 34 of the swingable leg 33 in the assembled position.

An 8-shaped engaging slot 44 is formed at a base portion of the sub lever 40. This engaging slot 44 of the tip end portion 43 of the sub lever 40 is engaged with an operating end 61 of an outside lever 60. The outside lever 60 is pivotably mounted on a bottom portion 25 of the base member 21.

As can be seen from FIGS. 1 to 3, an operating projection 45 is formed at an intermediate portion of the sub lever 40. The operating projection 45 of the sub lever 40 is so formed as to be engageable with an opening plate 26. The opening plate 26 is pivotably mounted on the bottom 25 of the base member 21. This opening plate 26 is rotated by the operating projection 45 of the sub lever 40 when the operating projection 45 is actuated, to release engagement of a pawl (not shown) with a latch (not shown) and release mesh between a striker (not shown) and a latch (not shown).

As shown in FIGS. 1 to 3, the lock lever 30 and the sub lever 40 are interlockably connected through the rod holder 50 so that they may move in gang.

Figure 4:
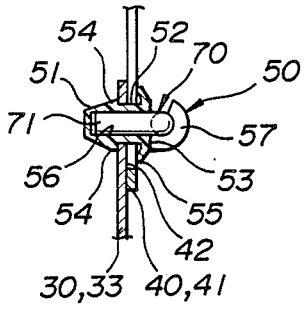
Figure 5:
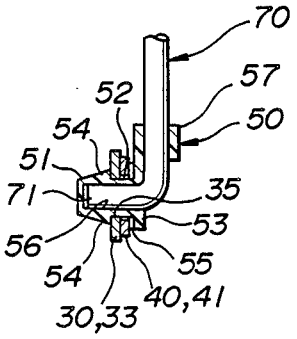
Figure 6:
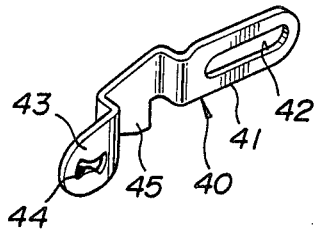

It can be seen from FIGS. 4 and 5, the leg portion 51 of the rod holder 50 is inserted and fitted through the elongated slot 42 of the tip end portion 41 of the sub lever 40 and the, insertion hole 35 of the swingable leg 33 of the lock lever 30.

The rod holder 50 has a neck portion 52 whose length is selected to be substantially equal to a total thickness of the swingable leg 33 of the lock lever 30 and the tip end portion 41 of the sub lever 40. The neck portion 52 of the rod holder 50 is adapted to be slidable in the elongated slot 42 of the tip end portion 41 of the sub lever 40. Thus, the rod holder 50 functions as a buffer for the sub lever 40 which makes swinging and sliding movements.

The rod holder 50 has a stopper projection 54 at its neck portion 52 on the side of the leg portion thereof. The holder 50 further has a pressing member 55 formed at the neck portion 52 on the side of a head portion 53 thereof. The stopper projection 54 and pressing member 55 of the rod holder 50 are so formed that they may hold the swingable leg 33 of the lock lever 30 and the tip end portion 41 of the sub lever 40 therebetween.

The rod holder 50 has a slot 56 which extends from the head portion 53 to the leg portion 51. This slot 56 is adapted to receive therein an L-shaped operating end 71 of a drive rod 70. The drive rod 70 acts as a transmitting member.

The drive rod 70 is connected to the lock lever 30 and the sub lever 40 through the rod holder 50. The drive rod 70 extends, through a hook portion 57 of the rod holder 50, to an inside lock knob (not shown).

The fabrication procedures of the link coupling arrangement for the door lock assembly 20 according to the present embodiment will now be described.

The swingable leg 33 of the lock lever 30 is first laid over the tip end portion 41 of the sub lever 40.

The leg portion 51 of the rod holder 50 is inserted through the elongated slide slot 42 on the tip end portion 41 of the sub lever 40 and the hole 35 on the swingable leg 33 of the lock lever 30. At this time, the rod holder 50 is pressed to pass through the hole and slot against the restoring force of the stopper projection 54.

After the insertion of the rod holder 50 through the hole 35 and the slot 42, the pressing member 55 of the rod holder 50 rests and presses against the tip end portion 41 of the sub lever 40. At the same time, the stopper projection 54 of the rod holder 50 is restored to engage with the swingable leg 33 of the lock lever 30 so that the leg portion 51 of the rod holder 50 is securely held. The slot 56 of the rod holder 50 is also restored so that it can receive the drive rod 70 therein.

The drive rod 70 is inserted, at its L-shaped operating end 71, into the slot 56 of the rod holder 50 and it is further fitted through the hook portion 57 of the drive rod 70.

The drive rod 70 is fitted in and firmly held by the hook portion 57 of the rod holder 50. On the other hand, the rod holder 50 itself is rigidly supported by the drive rod 70 inserted in the slot 56 of the rod holder 50, and accordingly, the stopper projection 54 of the rod holder is not easily bent or flexed. Thus, the rod holder 50 is surely and rigidly held in the swingable leg 33 of the lock lever 30 and the tip end portion 41 of the sub lever 40.

More specifically, the drive rod 70 is connected to the lock lever 30 and the sub lever 40 through the rod holder 50 in a ready but sure way with easiness.

If it is needed, for example, to replace the rod holder 50 by a new one after the drive rod 70 has been connected to the lock lever 30 and the sub lever 40 through the rod holder 50, the drive rod 70 is removed from the slot 56 and the hook portion 57 of the rod holder 50. Then, the rod holder 50 is disengaged from the hole 35 of the tip end portion 34 of the lock lever 30 and the elongated slide slot 42 of the tip end portion 41 of the sub lever 40. Thereafter, a new rod holder is fitted to the assembly. Thus, the replacement of the rod holder can be carried out easily in a short time.

The operation of the present embodiment will now be described.

Since the lock lever 30 and the sub lever 40 are overlapped and the rod holder 50 is fitted at the overlapped portion, the thickness (a length in a direction of B) of the rod holder 50, at its fitting portion, is only a length which is substantially equal to a length from the head portion 53 of the rod holder 50 to the leg portion 51 thereof as illustrated in FIG. 3. Thus, the thickness of the rod holder 50 at its fitting portion can be minimized.

The drive rod 70 is inserted in the slot 56 of the rod holder 50 for connection. Therefore, it is not necessary to further reserve a space for connecting the drive rod 70 other than the connecting portion between the lock lever 30 and the sub lever 40 but in the vicinity thereof.

When the inside lock knob is operated, the drive rod 70 reciprocates vertically in parallel with axis A1. As a result of this, the operation of the inside lock knob connected to the drive rod 70 is effectively transmitted to the lock lever 30 and the sub lever 40. Thus, the lock lever 30 and the sub lever 40 positively and surely oscillate to the lock position or release position.

Since the pressing member 55 of the rod holder 50 rests and presses against the tip end portion 41 of the sub lever 40, the elongated slide slot 42 of the sub lever 40 is guided stably and smoothly by the neck portion 52 of the rod holder 50 without causing jolting. Thus, the rod holder 50 also functions as a buffer for the sub lever 40.

According to the link connecting arrangement for the door lock assembly 20 of the first embodiment, the thickness of the connecting portion of the drive rod 70 can be reduced without increasing the width of the door lock assembly 20, while keeping good operating characteristics. This can provide a sufficient gap or space from a window glass.

Since the rod holder 50 also functions as a buffer for the sub lever 40 which slides, there is no need to provide a separate buffer member. This can reduce the number of steps for fabricating the link coupling arrangement for the door lock assembly 20. This has further advantage that replacement of the rod holder 50 after fabrication can be attained easily.

(Second Embodiment)

Figure 7:
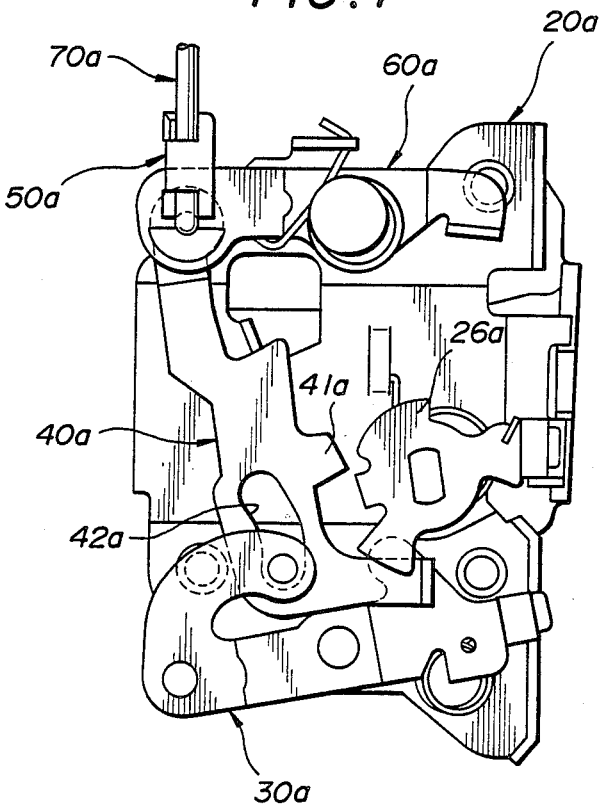
FIG. 7 is a front view of a second form of link coupling arrangement for a vehicle door lock assembly embodying the present invention.
Figure 8:
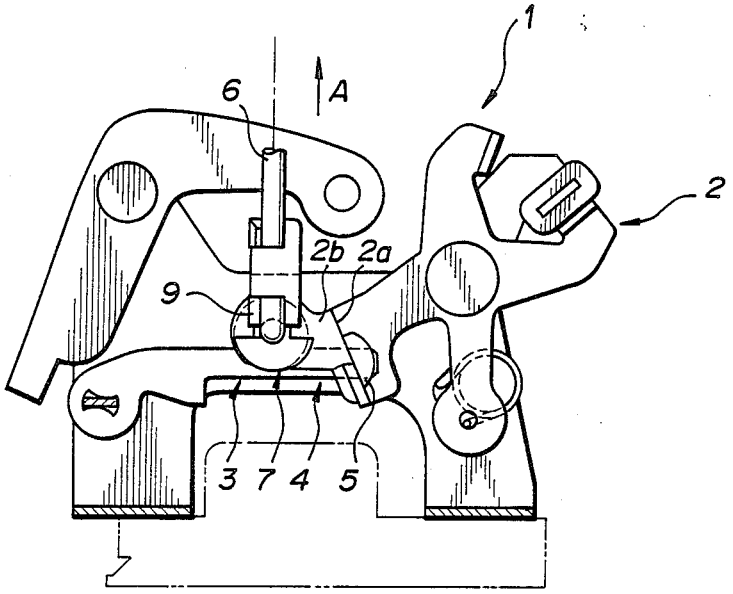
FIG. 8 PRIOR ART
FIGS. 8 and 9 illustrate a relative art.
Figure 9:
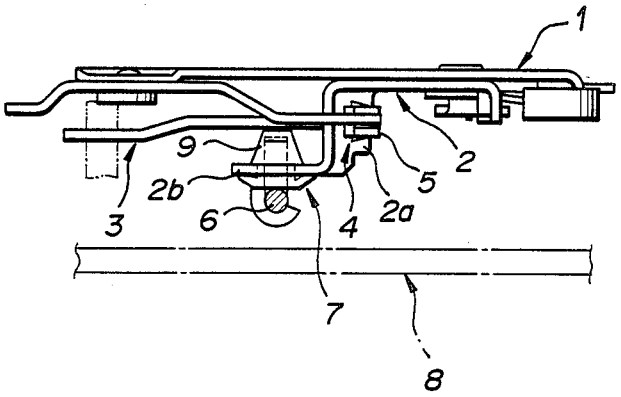
FIG. 9 PRIOR ART

FIG. 7 illustrates a second embodiment of the present invention.

In this second embodiment, a link coupling arrangement of a door lock assembly **20*a* is used for a front door. Two transmission link members of the link coupling arrangement are sub lever 40*a* and outside lever 60*a***.

The sub lever **40*a* has an end portion which is overlapped by the outside lever 60*a*. A drive rod 70*a* is connected to the overlapped portions through a rod holder 50*a***.

The sub lever **40*a* has an elongated slide slot 42*a* at another end thereof. The slot 42*a* is engaged with a lock lever 30*a*. The sub lever 40*a* further has an operating projection 41*a* which is formed so as to press to an opening plate 26*a*** to actuate the same.

As described above, since the drive rod **70*a* is connected to the sub lever 40*a* and the outside lever 60*a* through the rod holder 50*a*, there is no need to provide another connecting portion for the drive rod 70*a* and the thickness of the connecting portion of the drive rod 70*a*** can be reduced.

As apparent from the above, in the link coupling arrangement for a vehicle door lock assembly according to the present invention, a transmitting member is connected to a coupler member for connecting two transmission link members, saving a space for a connecting portion for the transmitting member. Therefore, the entire structure of the door lock assembly can be made compact. Furthermore, since the coupler member can function as a connecting member for the connection between the two transmission link members and a coupler member for the connection of the transmitting member, the structure of the link connecting arrangement can be simplified.

I claim:

1. A link coupling arrangement for a vehicle door lock assembly, comprising a pair of transmission link members interlockably mounted together on a body of the vehicle door lock assembly, a transmitting member for driving the pair of transmission members; and a coupler member for interlocking the transmission link members and transmitting member together, said coupler member including connecting means for connecting the transmission link members together by reception of the connecting means through the link members in a first direction and by reception of the transmitting member into the connecting means in said first direction.

2. A link coupling arrangement for a vehicle door lock assembly as claimed in claim 1, wherein said transmitting member is a drive member connected to an inside lock knob of the vehicle door lock assembly and said two transmission link members are a first lever member which is primarily actuated by said drive member to oscillate to a locking position or a releasing position and a second lever member which is connected to means for operating a pawl and a latch of the vehicle lock assembly.

3. A link coupling arrangement for a vehicle door lock assembly as claimed in claim 2, wherein said drive member is a drive rod and said coupler member is a rod holder for holding said drive rod therein, said rod holder being fitted through said first and second lever members in said first direction which are laid over one another for coupling, to interlockably connect the same, whereby the said first and second lever members are actuated interlockingly by said drive rod through said rod holder.

4. A link coupling arrangement for a vehicle door lock assembly as claimed in claim 3, wherein said first lever member is pivotable and has a swingable end portion with a hole, said second lever member having an elongate slide slot, and said rod holder is fitted through said hole of the first lever member and said elongate slide slot of the second lever member.

5. A link coupling arrangement for a vehicle door lock assembly as claimed in claim 3, wherein said rod holder is made of a resilient material and has a leg portion, a neck portion, a stopper projection and a pressing member formed on said neck portion and a hook portion, all formed integrally and of unitary construction with each other, said leg portion and said neck portion having a slot extending therethrough for receiving an operating end portion of said drive rod, and said hook portion spaced from the leg portion and holding said drive rod to retain same on the holder, said stopper projection and pressing member being adapted to hold said first and second lever members therebetween after said rod holder has been fitted therethrough.

6. A link coupling arrangement for a vehicle door lock assembly as claimed in claim 5, wherein said leg portion of the rod holder has a length substantially equal to a total thickness of the first and second lever members.

7. The link coupling arrangement of claim 6, wherein said pressing member is a resilient lug preventing jolting or backlash between the levers and between the levers and the holder.

* * * * *